United States Patent [19]

Roberts

[11] 4,109,492

[45] Aug. 29, 1978

[54] NO ROLL STOCKING AND METHOD

[75] Inventor: Fred B. Roberts, Burlington, N.C.

[73] Assignee: Burlington Industries, Inc., Greensboro, N.C.

[21] Appl. No.: 722,754

[22] Filed: Sep. 13, 1976

[51] Int. Cl.[2] ..... D04B 9/24; D04B 9/54

[52] U.S. Cl. ..... 66/172 E

[58] Field of Search ..... 66/172 E, 198, 178 A, 66/173

[56] References Cited

U.S. PATENT DOCUMENTS

| | | | |
|---|---|---|---|
| 1,929,006 | 10/1933 | Snader | 66/178 A X |
| 2,247,343 | 6/1941 | Fregeolle | 66/172 E |
| 2,256,691 | 9/1941 | Smith, Jr. | 66/172 E |
| 2,283,585 | 5/1942 | Smith, Jr. | 66/172 E |
| 2,306,914 | 12/1942 | Smith, Jr. | 66/172 E |
| 2,313,332 | 3/1943 | Fregeolle | 66/172 E |
| 2,319,955 | 5/1943 | Smith, Jr. | 66/172 E |
| 2,380,768 | 7/1945 | Lawson | 66/172 E |
| 2,598,144 | 5/1952 | Smith | 66/172 E |
| 2,799,151 | 7/1957 | Elder et al. | 66/172 E |
| 3,166,922 | 1/1965 | York et al. | 66/172 E |
| 3,237,431 | 3/1966 | Lawson | 66/172 E X |
| 3,729,956 | 5/1973 | Nebel et al. | 66/172 E |
| 3,906,753 | 9/1975 | Siegfried | 66/172 E |
| 4,023,384 | 5/1977 | Conti et al. | 66/172 E |

*Primary Examiner*—Wm. Carter Reynolds
*Attorney, Agent, or Firm*—Cushman, Darby & Cushman

[57] ABSTRACT

A stocking, and the method of manufacturing it, that is single thickness throughout the length thereof, yet does not roll at the top under normal use. For a knee-high stocking, a top section about 7–11 courses wide is formed of only elastic yarn, jersey stitched. The first few courses (or more) of the top section have $x$ wales therein, where $x$ is an integer greater than 1, while a mock ribbed section of the stocking just below the top section has 2 $x$ wales therein. Loops are received by alternate needles of $2x$ needles of a conventional circular knitting machine during the second course and are held during knitting of subsequent courses so that wale contraction of the top section of the stocking occurs after removal of the stocking from the knitting machine. For casual stockings and also for knee-highs, alternatively the first course may be formed with $x$ wales of both elastic yarn and inelastic yarn, jersey stitched, the second course of $2x$ wales of jersey stitched only inelastic yarn, the third course of $2x$ wales of both elastic and inelastic yarn jersey stitched, and the fourth course of pure inelastic yarn tuck stitched, to form a nonroll top section of the stocking. After that a mock ribbed section is formed.

4 Claims, 7 Drawing Figures

NO ROLL STOCKING AND METHOD

BACKGROUND AND SUMMARY OF THE INVENTION

The invention relates to the provision of stockings, especially women's knee-high stockings and men's nylon stockings and the like, that are single thickness throughout the entire length thereof yet do not roll at the top. It is conventional when forming single thickness stockings to provide a double thickness area or welt at the top of the stockings (see U.S. Pat. No. 3,908,407, for example). This provides complications during manufacture over an arrangement wherein the stocking can be made single thickness throughout the entire length thereof. According to the present invention, a truly single thickness stocking can be provided that still does not roll during normal use thereof, and is relatively inexpensive to construct.

According to a first embodiment of the present invention, a knee-high stocking is provided having a top section — about 7-11 courses — formed of jersey stitched pure elastic yarn. The stocking is knit on a conventional circular knitting machine having $2x$ needles, and at least the first 3 of the courses of the top section have only $x$ wales, except the second course which has $2x$ wales. During the knitting of the second course all the $2x$ needles are brought into play, and the loops received by the alternate needles of the $2x$ needles are held during knitting of the subsequent courses having only $x$ wales. The elastic yarn held thereby is placed under tension since no yarn is being fed while the loops are being held, and when the stocking is removed from the knitting machine there is a waleswise contraction thereof. A plurality of courses of jersey stitched elastic yarn having $2x$ wales can be knit after the courses having $x$ wales, before knitting of the ribbed section of the stocking is initiated.

According to first and second embodiments of the present invention, the mock ribbed section of the stocking is knit by providing alternate courses (9th, 11th, etc. where 8 courses are provided for the top section) of floating (i.e., floating three out of four needles) elastic yarn and inelastic yarn, jersey stitched, and intervening courses (10th, 12th, etc.) of only inelastic yarn. The courses of only inelastic yarn may be tuck stitched if desired to further enhance the nonrolling properties of the stocking. Two $x$ wales are provided in the mock ribbed section. After the relatively wide ribbed section is knit, the body portion of the stocking is knit of relatively inelastic yarn. Suitable yarns for producing knee-high stockings according to the present invention are spandex as the elastic yarn, Superloft as the inelastic yarn in the ribbed section (which may be of contrasting color and feel to the body portion), and relatively low-denier nylon in the body portion.

Also, according to the one embodiment of the present invention, a casual or knee-high stocking may be produced having a mock ribbed section formed like the mock ribbed section of the stocking described above and having a top section (to prevent rolling of the stocking) of about 4 specially formed courses. The first (top most) course of the top section comprises $x$ wales of both elastic yarn and inelastic yarn jersey stitched, the second course comprises $2x$ wales of only inelastic yarn jersey stitched, the third course both elastic and inelastic yarn jersey stitched, and the fourth course only inelastic yarn tuck stitched. Suitable yarns for casual stockings that are so formed would be spandex for the elastic yarn, and relatively high denier nylon for the inelastic yarn.

It is the primary object of the present invention to provide an improved knee-high or casual single thickness stocking that is truly single thickness over the entire length thereof, yet does not roll at the top during normal usage. This and other objects of the present invention will become clear from an inspection of the detailed description of the invention and from the appended claims.

DETAILED DESCRIPTION OF THE INVENTION

Figure 1:
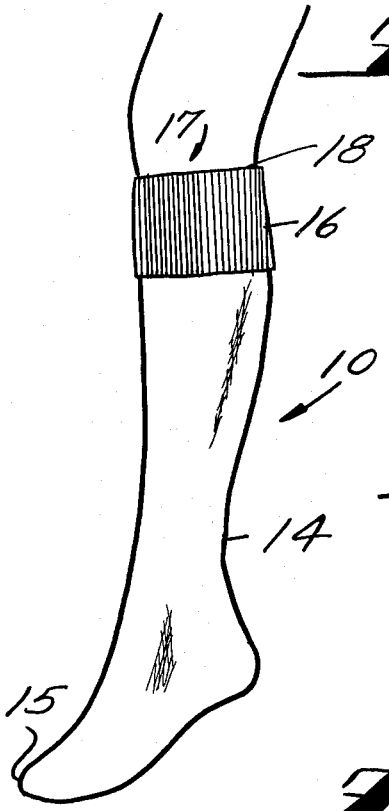
FIG. 1 is a perspective view of an exemplary knee-high stocking according to the present invention in use on a wearer.
Figure 5:
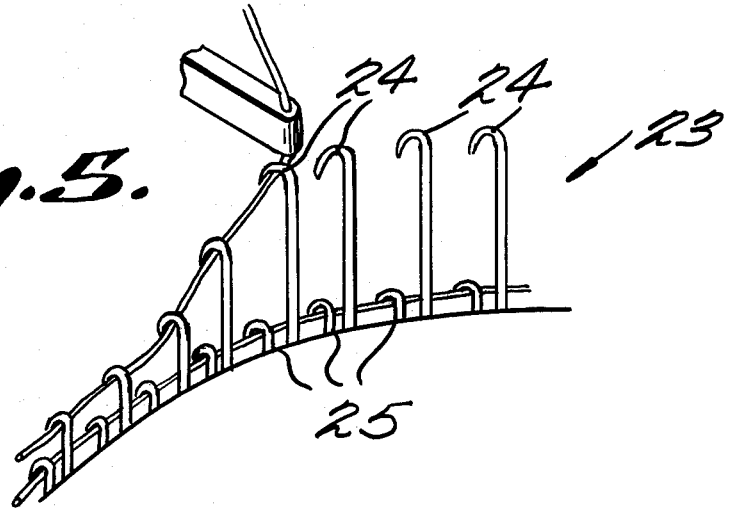
FIG. 5 is a diagrammatic view of needles of a conventional circular knitting machine in a position wherein half the needles thereof are holding a loop from a previous course while the other half are knitting.

According to the present invention a knee-high stocking 10 such as shown in FIG. 1, and a casual stocking 12 such as shown in FIG. 5 are produced which have nonrolling tops. Conventional nonrolling stockings are produced by forming a welt at the top thereof, however, according to the present invention the stockings are of single thickness throughout the length thereof. The knee-high stocking 10 according to the present invention includes a body portion 14 including a toe section 15, a mock ribbed section 16 above the body portion 14, having an open top 17, and means for preventing rolling of the top of the stocking, said means comprising a plurality of jersey-stitched elastic yarn courses providing a relatively narrow top section 18 for the ribbed section 16. The body portion 14 conventionally is formed of relatively inelastic, low-denier yarn, while the ribbed section may be of contrasting color to said body portion, and formed of alternate courses of floated elastic yarn and inelastic yarn, and a plurality of intervening courses of only inelastic yarn.

Throughout the specification and claims, the term "elastic yarn" means a yarn that is relatively elastic, such as spandex, while the term "inelastic yarn" means a yarn that is relatively inelastic, such as Superloft or nylon.

Figure 2:
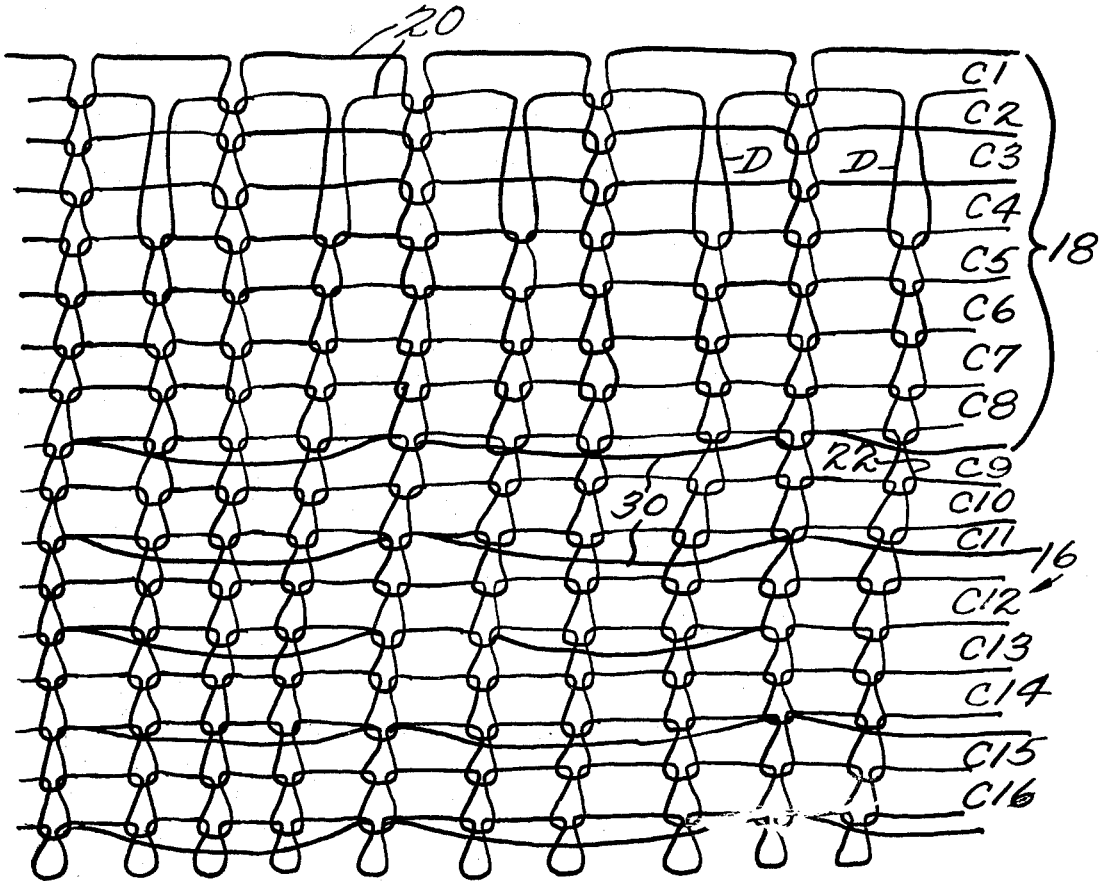
FIG. 2 is an enlarged stitch diagram showing the uppermost courses of stitches in the exemplary stocking of FIG. 1.

A stitch diagram of the top section 18 and the uppermost courses of the ribbed section 16 of the exemplary stocking 10 according to the present invention is provided in FIG. 2. In FIG. 2, the top eight courses of the stocking 10, which eight courses comprise the top section 18, are plain jersey stitches of spandex. The top section 18 comprises a means for preventing the rolling of the stocking top. The section 18 is knit on a standard circular knitting machine having $2x$ or more needles, wherein $x$ is an integer greater than 1, so that it can knit 2x wales. A small section of such a knitting machine is shown generally at 23 in FIG. 5, having one set of a plurality of needles 24, and another alternate set of a plurality of needles 25, each set having x needles. The top most course C1 of the top section 18 comprises x wales, the topmost course formed by using only x number of needles (the set 24) to knit jersey stitches while x number of needles (the set 25) are in inoperative position below sinker level. During knitting of the second course C2, all of the needles 24, 25 are brought into operation and then during the knitting of the third course C3, and a plurality of other courses in top section 18, the needles 25 are in inoperative position (shown in FIG. 5) holding the loop that they received from the second course. Thus, from the first or topmost course through a plurality of other courses, only x wales will be formed, except the second course which has 2x wales. Preferably 8–12 courses of elastic, jersey stitched yarn are provided in the top section 18, and preferably the top 4–12 courses of the courses in the top section 18 have only x wales therein.

While the upper courses of the top section 18 are being knit with only x wales therein, and with the loops received during knitting of the second course being held by the hooks 25, the elastic yarn D of the second course has loops being held is placed under tension since no further yarn is being fed thereto. Thus, when the stocking 10 is ultimately removed from the machine 23 after knitting is completed, the yarn D will cause contraction of the wales in the top section 18, and thus the top section 18 will be relatively narrow despite the fact that about 8–12 courses are provided therein.

Figure 3:
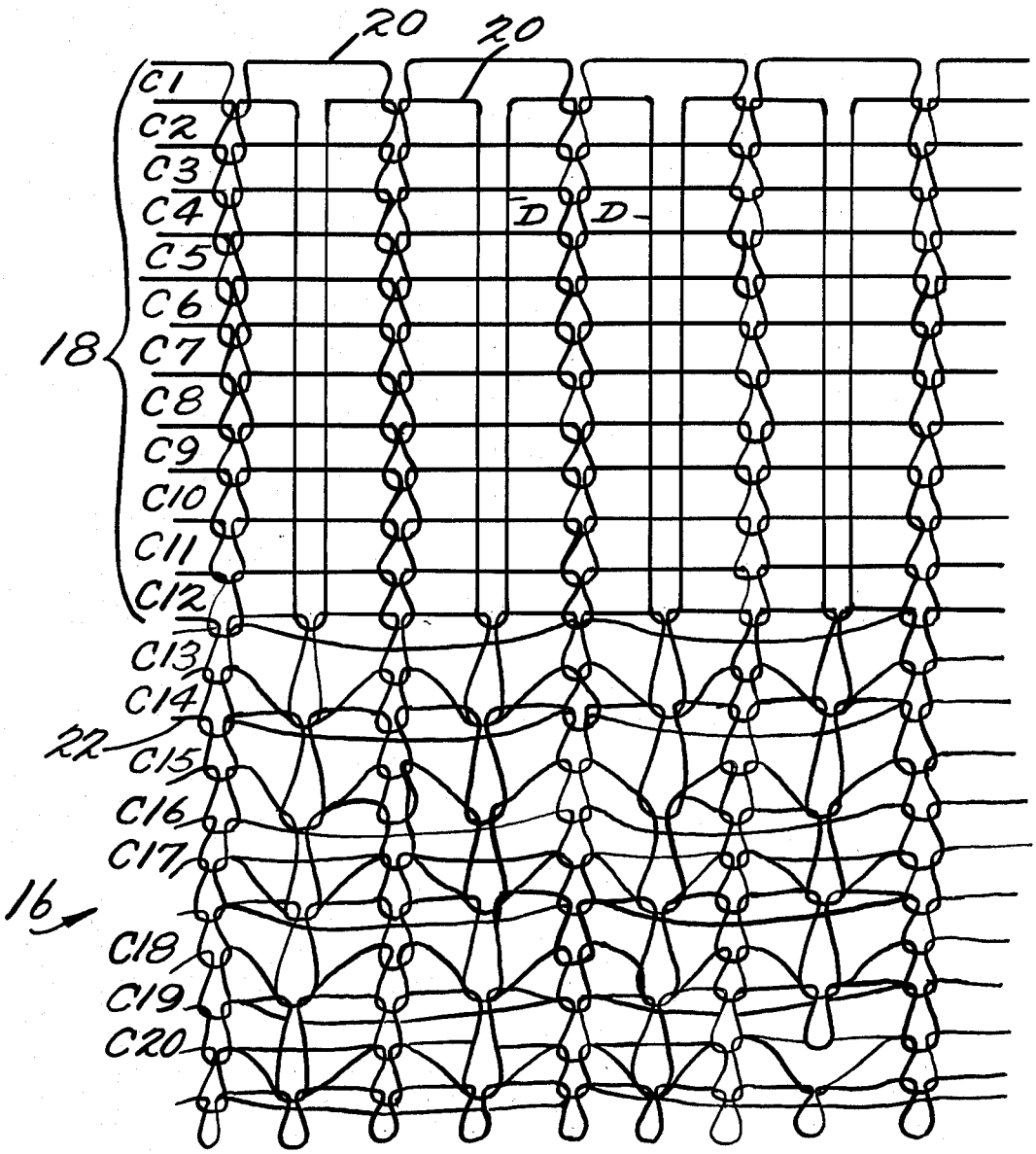
FIGS. 3 and 4 are stitch diagrams showing modifications of the FIG. 2 embodiment.

FIG. 3 shows a modification of the structure of the upper portions of the stocking 10, wherein the loop of the yarn D received during knitting of the second course is held during the entire knitting of the top section 18 — in the case of FIG. 3 for 11 courses — rather than just for 3 courses, as in FIG. 2, before 2x wales are jersey stitched with elastic yarn. Normally, at least 3 wale courses are provided as the first courses of section 18. While 8–12 courses have been given as a practical estimate of the number of courses that are to be provided in the top section 18 to effect the non-rolling characteristics which are imparted to the stocking 10 by the top section 18, it is to be understood that any number of courses more than about 3 can be provided as long as the non-rolling function is achieved, and as long as the provision of the elastic courses at the top of the stocking is not so large as to be unpleasing aesthetically or so as to cause undue bulging of the rib section 16.

Figure 4:
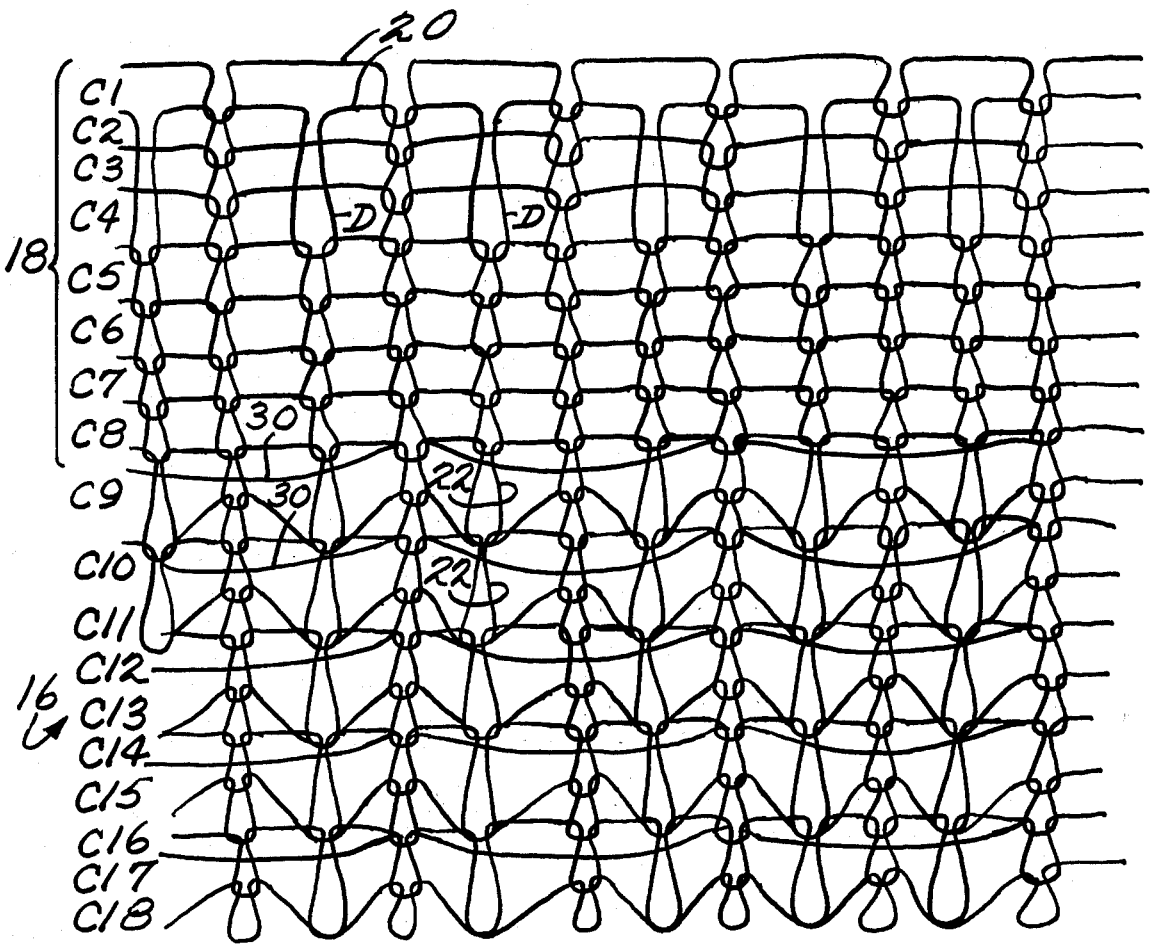

The ribbed section 16 in FIG. 2 consists of alternate courses of a combination of elastic yarn 30 and inelastic yarn 22 (C9, C11, etc.), and only inelastic yarn 22 (C10, C12, etc.). The elastic yarn 30 is shown floating three needles out of four in FIG. 2, the yarn 30 being floated in and knitted on every fourth needle to produce a mock rib fabric; however, other floating arrangements therefor also may be provided, in fact any floating arrangement that produces mock ribbing. In the modification of FIG. 2 plain jersey stitches are provided for all of the courses C9+, however, if desired, tuck stitches may also be utilized to enhance the mock ribbing effect, and to assist in preventing rolling of the top portion of the stocking. Tuck stitching that is employed to assist in preventing rolling of the top portion of the stocking is shown in FIG. 4, the alternate courses (C9, C11, etc.) that contain both floating elastic yarn 30 and inelastic yarn 22 being jersey stitched, while the alternate courses (C10, C12, etc.) that contain only inelastic yarn 22 are tuck stitched. The mock ribbed section 16 has 2x wales therein.

After the mock ribbed section 16, which preferably may be about 2½ inches in length and of contrasting color to the body portion 14, is knit, the body portion 14 is knit, preferably of relatively inelastic yarn having 2x wales. A toe section 15 is provided by conventional techniques. As a preferred example of materials that could be used in knitting a stocking 10, the elastic yarn forming the top section 18 could be spandex, the elastic yarn in the ribbed section 16 could be spandex while the inelastic yarn was Superloft, and the inelastic yarn forming the body portion 14 could be nylon.

Figure 6:
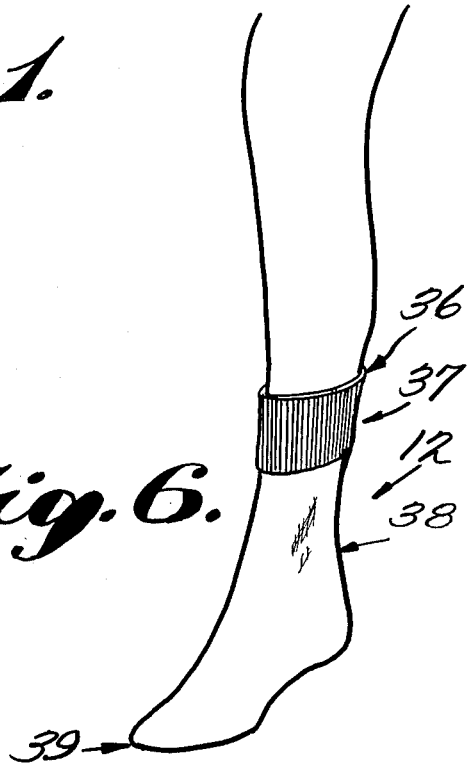
FIG. 6 is a perspective view of an exemplary casual stocking according to the present invention in use on a wearer.
Figure 7:
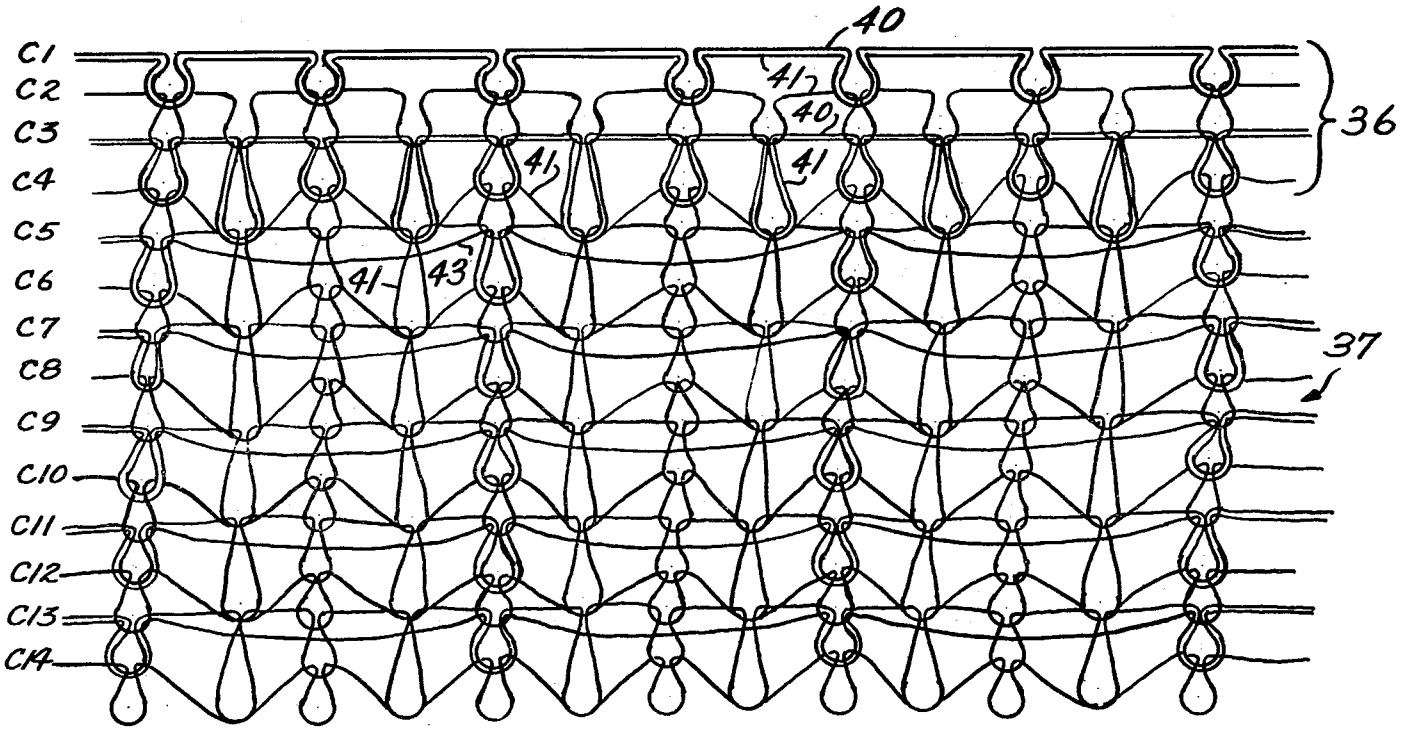
FIG. 7 is an enlarged stitch diagram showing the uppermost courses of stitches in the stocking of FIG. 6.

A casual stocking 12 according to the present invention, which has a nonrolling top is shown in FIG. 6, and a stitch diagram for the top thereof is shown in FIG. 7. While shown as an anklet, the stocking 12 also could be a knee-high. The stocking 12 is also formed on a conventional knitting machine, and the techniques applicable thereto could also be provided for knee-high stockings like the stocking 10, although the stocking 12 in FIG. 7 will usually be formed of a higher denier yarn which lends itself to the stitching of FIG. 7 more readily than to the relatively low denier yarn utilized in the knee high stocking 10.

The uppermost course C1 of the stocking 12 of FIG. 7 comprises both elastic yarn 40 and inelastic yarn 41 in jersey stitches with x wales, wherein x is an integer greater than 1, and wherein the knitting machine (23) on which the stocking 12 is to be formed has 2x (or more) needles. The second course C2 comprises only inelastic yarn 41 in jersey stitches, the second course C2 and all succeeding courses having 2x wales. The third course C3 comprises both elastic yarn 40 and inelastic yarn 41 in jersey stitches, while the fourth course C4 comprises only inelastic yarn 41 in tuck stitches. After the first four courses which form a non-rolling top section 36 of the stocking 12, a plurality of alternate courses of floated elastic yarn 43, and inelastic yarn 41 (courses C5, C7, etc.), and a plurality of intervening courses only inelastic yarn 41 (courses C6, C8, etc.) are provided to form a mock ribbed section 37 of the stocking 12, the ribbed mock section 37 being relatively wide (i.e., about 1.75 inches). Yarn 43 is stitched in or knit in every fourth needle. After the ribbed section 37 is formed, a body portion 8 is knit of relatively high denier inelastic yarn, a toe section 39 being formed in the body portion 38 by conventional means. In the mock ribbed section 37, in order to enhance the non-rolling properties of the stockings, it is preferable that the intervening courses (C6, C8, etc.), having only inelastic yarn therein, are tuck-stitched, while the alternate courses (C5, C7, ect.) having both floated elastic yarn, and inelastic yarn therein, are jersey-stitched. For the stocking 12, preferably, the elastic yarn is spandex while the inelastic yarn, throughout the stocking, is relatively highdenier nylon.

It will thus be seen that according to the present invention, a stocking (and method of making the stocking) has been provided that is of single thickness throughout the length thereof, yet will not roll at the top during normal use.

While the invention has been herein shown and described in what is presently conceived to be the most practical preferred embodiment thereof, it will be apparent to those of ordinary skill in the art that many modifications may be made thereof within the scope of the invention, which scope is to be accorded the broadest interpretation of the appended claims so as to encompass all equivalent articles and methods.

What is claimed is:

1. A stocking having a single thickness throughout the length thereof, comprising a topmost course comprising both elastic yarn and inelastic yarn jersey stitches with $x$ wales, wherein $x$ is an integer greater than one, a second course comprising only inelastic yarn jersey stitches, said second course and all succeeding courses having $2x$ wales, a third course comprising both elastic yarn and inelastic yarn jersey stitches, a fourth course comprising only inelastic yarn tuck-stitches, a plurality of alternate courses of floated elastic yarn and inelastic yarn and a plurality of intervening courses of only inelastic yarn providing a relatively wide mock ribbed section, and an inelastic yarn sock body portion including a toe.

2. A stocking as recited in claim 1 wherein said mock ribbed section alternate courses of pure inelastic yarn are tuck-stitched.

3. A stocking as recited in claim 1 wherein said elastic yarn is spandex and wherein said inelastic yarn is nylon.

4. A method of making a single thichness stocking including a top section, a mock ribbed section, and a body portion including a toe, comprising the steps of knitting in jersey stiches a topmost course comprising both elastic yarn and inelastic yarn and having $x$ wales where $x$ is an integer greater than 1, knitting a second and succeeding courses having $2x$ wales, said second course comprising jersey-stiched only inelastic yarn, knitting in hersey stitches a third, succeeding course comprising both elastic yarn and inelastic yarn, knitting in tuck-stitches a fourth, succeeding, course comprising only inelastic yarn to privide a relatively wide mock ribbed section, and knitting an inelastic yarn body portion of the stocking, including toe, to complete the stocking.

* * * * *